US010207398B2

(12) United States Patent
Ma

(10) Patent No.: US 10,207,398 B2
(45) Date of Patent: Feb. 19, 2019

(54) TOOL ASSEMBLY

(71) Applicant: Xingqing Ma, Huizhou (CN)

(72) Inventor: Xingqing Ma, Huizhou (CN)

( * ) Notice: Subject to any disclaimer, the term of this patent is extended or adjusted under 35 U.S.C. 154(b) by 176 days.

(21) Appl. No.: 15/400,968

(22) Filed: Jan. 7, 2017

(65) Prior Publication Data

US 2018/0104807 A1 Apr. 19, 2018

(30) Foreign Application Priority Data

Oct. 19, 2016 (CN) ..... 2016 2 1140435 U

(51) Int. Cl.

| | |
|---|---|
| ***B25F 1/02*** | (2006.01) |
| ***B25G 1/00*** | (2006.01) |
| ***B25G 1/08*** | (2006.01) |
| ***B25B 13/46*** | (2006.01) |
| ***B25B 15/00*** | (2006.01) |
| ***B25B 27/00*** | (2006.01) |

(52) U.S. Cl.

CPC ..... *B25F 1/02* (2013.01); *B25B 13/463* (2013.01); *B25B 15/005* (2013.01); *B25B 15/008* (2013.01); *B25B 27/0035* (2013.01); *B25B 27/0071* (2013.01); *B25G 1/005* (2013.01); *B25G 1/085* (2013.01)

(58) Field of Classification Search

CPC .... B25B 27/0071; B25B 15/008; B25G 1/005
USPC ..... 81/61
See application file for complete search history.

(56) References Cited

U.S. PATENT DOCUMENTS

| | | | | |
|---|---|---|---|---|
| 827,846 | A * | 8/1906 | Bowser | B25B 13/463 81/61 |
| 1,724,491 | A * | 8/1929 | Siegmund | B25B 13/463 81/124.6 |
| 6,739,224 | B1 * | 5/2004 | Wershe | B25G 1/085 7/138 |
| 10,040,185 | B2 * | 8/2018 | Davis | B25F 1/04 |
| 2003/0188605 | A1 * | 10/2003 | Chang | B25B 15/02 81/60 |
| 2006/0288823 | A1 * | 12/2006 | Schepman | B25B 13/463 81/60 |

* cited by examiner

*Primary Examiner* — Hadi Shakeri

(57) ABSTRACT

A tool assembly includes a first tool and a second tool. The first tool includes a first tool body, a ratchet mechanism defining a first hole, and a receiving space. The ratchet mechanism includes a ratchet having a plurality of teeth and a pair of pawls, and a first end of each of the pawls is received between two adjacent teeth. The second tool includes a first inner hexagonal wrench and a first outer hexagonal opener. The first outer hexagonal opener may be received in the first hole. When the first tool rotates relative to the ratchet mechanism along a first direction, the pawls rotates with the first tool and drives the ratchet together with the second tool rotates along the first direction; when the first tool rotates along a second direction opposite to the first direction, the ratchet together with the second tool is in a static state.

19 Claims, 4 Drawing Sheets

TOOL ASSEMBLY

BACKGROUND

1. Technical Field

The present disclosure generally relates to a tool assembly.

2. Description of Related Art

Scooters as extreme sports tools, often are used violent action, so the scooters are often be damage and need be repaired. But traditional tool assembly for repairing a scooter includes a plurality of tools which are not be integrated as a whole, resulting in accidental loss of some tools.

Therefore, a need exists in the industry to overcome the described problems.

SUMMARY

The disclosure relates to a tool assembly.

In one aspect, a tool assembly includes a first tool, a second tool, and an L-shaped third tool. The first tool includes a first tool body, a ratchet mechanism defining a first hole and located in an inner portion of the first tool body, a receiving space extending through the first tool body along an axial direction of the first tool body, a first connecting hole located in an end of the first tool body, and a receiving groove located a face of the first tool body. The second tool includes a first inner hexagonal wrench located a first end thereof and a first outer hexagonal opener located a second end thereof, wherein the second tool is configured to be received in the receiving space. The third tool includes a screwdriver and a second outer hexagonal opener, wherein the second outer hexagonal opener is configured to be inserted into the first connecting hole, and the screwdriver is configured to be received in the receiving groove. When the first tool rotates relative to the ratchet mechanism along a first direction, the ratchet mechanism rotates along the first direction; when the first tool rotates along a second direction opposite to the first direction, the ratchet mechanism is in a static state.

Wherein the first inner hexagonal wrench defines a second hole corresponding to the first hole, the second outer hexagonal opener is configured to be inserted into the first hole and the second hole.

Wherein the first tool comprises a pair of second inner hexagonal wrenches located in inner faces of opposite ends of the receiving space.

Wherein the second outer hexagonal opener comprises a protruding portion to prevent the second outer hexagonal opener from accidentally disengaging from the first tool.

Wherein the first hole has an inner hexagonal shape, and the first outer hexagonal opener is configured to be received in the first hole.

Wherein the ratchet mechanism comprises a ratchet having a plurality of teeth and a pair of pawls, and a first end of each of the pawls is received between two adjacent teeth, wherein when the first tool rotates relative to the ratchet mechanism along the first direction, the pawls rotates with the first tool and drives the ratchet and the second tool rotates along the first direction, when the first tool rotates along the second direction opposite to the first direction, the ratchet and the second tool is in a static state.

Wherein the first tool defines a pair of first receiving holes and a pair of second receiving holes in communication with the first receiving holes.

Wherein a second end of each of the pawls is fixed in a corresponding first receiving hole.

Wherein the ratchet mechanism comprises a pair of springs each received in a corresponding second receiving hole and abutting against a corresponding pawl to drive the corresponding pawl to reset.

Wherein when the first tool rotates along the first direction, each of the springs is in a compression state; when the first tool rotates along the second direction, each of the springs is in a free state.

In another aspect, a tool assembly includes a first tool and a second tool and an L-shaped third tool. The first tool includes a first tool body, a ratchet mechanism defining a first hole and located in an inner portion of the first tool body, and a receiving space extending through the first tool body along an axial direction, and a first connecting hole located in an end of the first tool body and a receiving groove located a face of the first tool body. The ratchet mechanism includes a ratchet having a plurality of teeth and a pair of pawls, and a first end of each of the pawls is received between two adjacent teeth. The second tool includes a first inner hexagonal wrench located a first end thereof and a first outer hexagonal opener located a second end thereof, wherein the first outer hexagonal opener is configured to be received in the first hole. The L-shaped third tool comprising a screwdriver and a second outer hexagonal opener, and, wherein the second outer hexagonal opener is configured to be inserted into the first connecting hole. The L-shaped third tool comprising a screwdriver and a second outer hexagonal opener, and, wherein the second outer hexagonal opener is configured to be inserted into the first connecting hole, and the screwdriver is configured to be received in the receiving groove. When the first tool rotates relative to the ratchet mechanism along a first direction, the pawls rotates with the first tool and drives the ratchet together with the second tool rotates along the first direction; when the first tool rotates along a second direction opposite to the first direction, the ratchet together with the second tool is in a static state.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
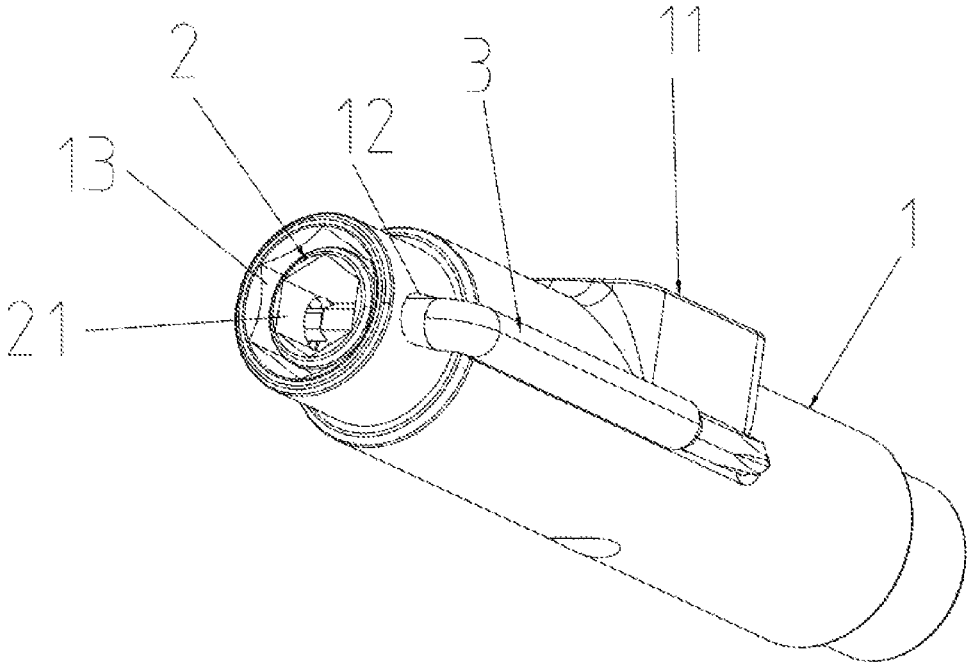
FIG. 1 is an assembled perspective view of a tool assembly in accordance with the present invention.

The disclosure is illustrated by way of example and not by way of limitation in the figures of the accompanying drawings, in which like reference numerals indicate similar elements. The embodiments described in accordance with the drawings are only examples, and thus the claimed invention is not limited thereto.

Referring to FIG. 1, the tool assembly includes a first tool 1, a second tool 2, and an L-shaped third tool 3.

In one embodiment, the tool assembly is use to mount/disengage a scooter.

Figure 2:
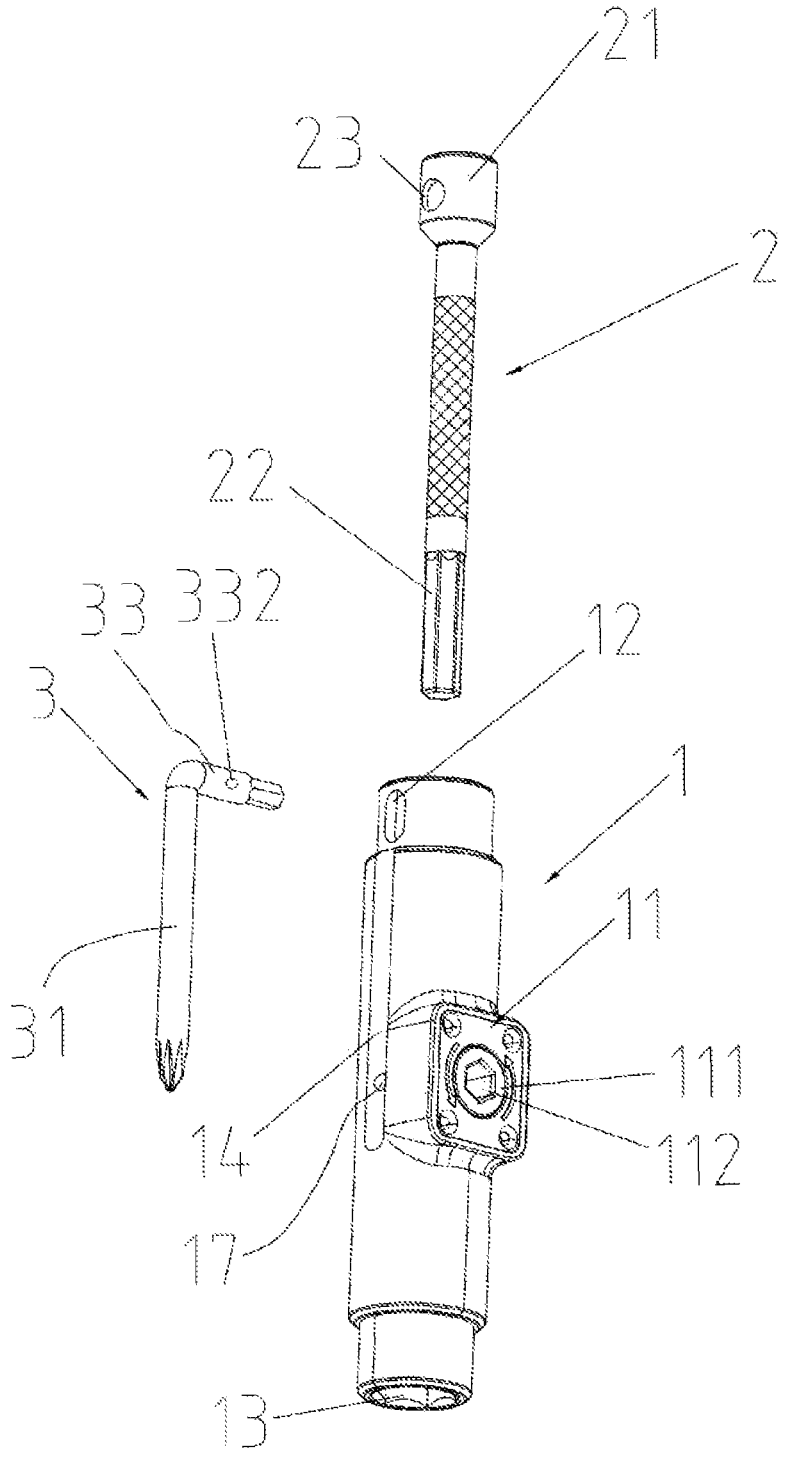
FIG. 2 is an exploded perspective view of the tool assembly of FIG. 1.
Figure 3:
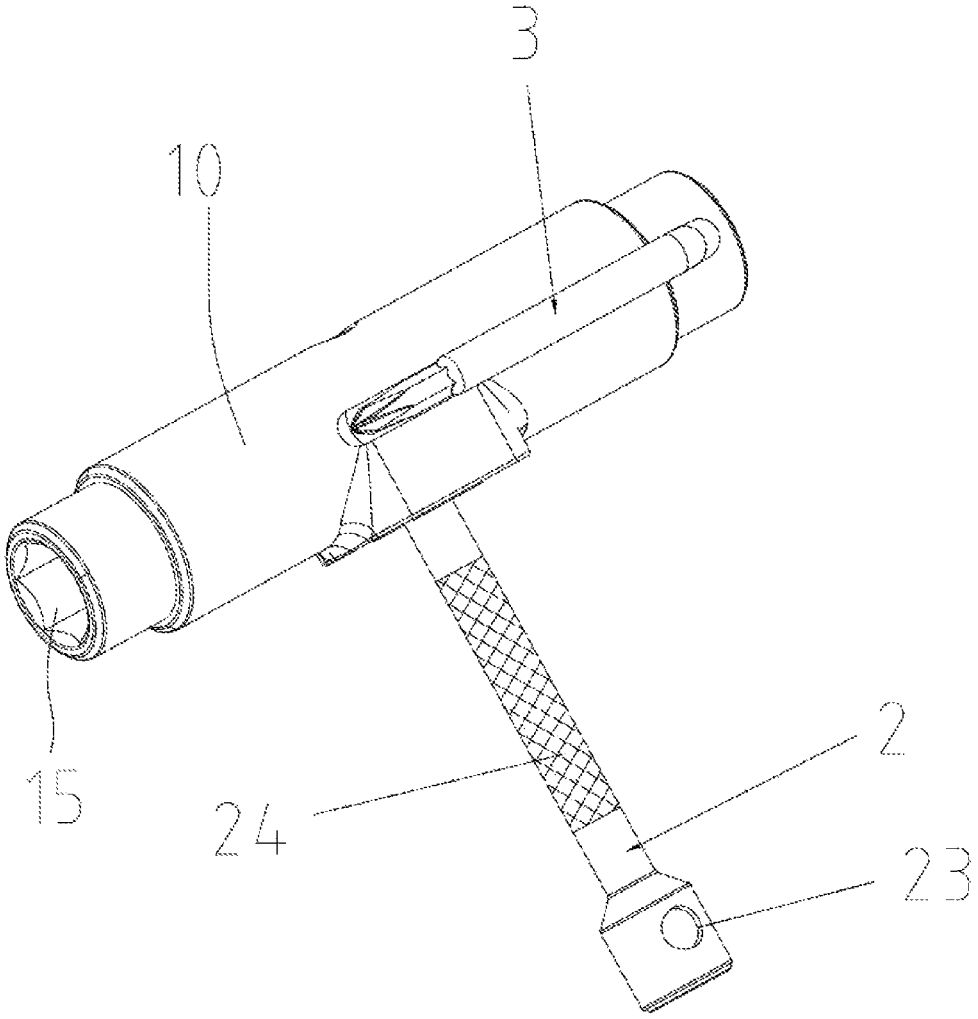
FIG. 3 is a perspective view of a second tool inserted into a first tool of the tool assembly of FIG. 1.

Referring to FIG. 2 and FIG. 3, the first tool 1 includes a first tool body 10, a ratchet mechanism 11 defining a first hole 112 and located in an inner portion of the first tool body 10, a receiving space 13 extending through the first tool body 10 along an axial direction of the first tool body 10, a first connecting hole 12 located in an end of the first tool body 10, and a receiving groove 14 located a face of the first tool body 10.

The second tool 2 includes a first inner hexagonal wrench 21 located a first end thereof and a first outer hexagonal opener 22 located a second end thereof. The second tool 2 is configured to be received in the receiving space 13 after use, thereby facilitating to packaging and transportation, and preventing the second tool 2 from accidental loss.

In one embodiment, the second tool 2 includes a second tool body having a plane for smoothing rough profile.

The L-shaped third tool 3 includes a screwdriver 31 and a second outer hexagonal opener 33. The first inner hexagonal wrench 21 defines a second hole 23 corresponding to the first hole 12. The second outer hexagonal opener 33 is configured to be inserted into the first hole 12 and the second hole 23, and the screwdriver 31 is configured to be received in the receiving groove 14, thereby the third tool 3 is mounted to the first tool 1 after use, thereby facilitating to packaging and transportation, and preventing the second tool 2 from accidental loss.

That is to say, the first tool 1, the second tool 2, and the third tool 3 can be integrated as a whole, resulting in facilitating to packaging and transportation, and preventing the second tool 2 and the third tool 3 from accidental loss.

Referring to FIG. 2, the second outer hexagonal opener 33 includes a protruding portion 332 to prevent the second outer hexagonal opener 33 from accidentally disengaging from the first tool 1. The first tool 1 includes a magnet 17 located in a bottom face of the receiving groove 14 to prevent the screwdriver 31 from wobbling in the receiving groove 14.

In one embodiment, the first connecting hole 12 is an oval hole. When the protruding portion 332 is corresponding to short edges of the first connecting hole 12, the second outer hexagonal opener 33 can be inserted to the first connecting hole 12; when the protruding portion 332 is corresponding to long edges of the first connecting hole 12, the second outer hexagonal opener 33 cannot disengage from the first tool 1, thereby preventing the second outer hexagonal opener 33 from accidentally disengaging from the first tool 1.

Referring to FIG. 1 and FIG. 2, the first tool 1 includes a pair of second inner hexagonal wrenches 15 located in inner faces of opposite ends of the receiving space 13.

In one embodiment, a diameter of each of the second inner hexagonal wrenches 15 is different from that of the first inner hexagonal wrench 21, and a diameter of the second outer hexagonal opener 33 is different from that of the first outer hexagonal opener 22, thus the tool assembly can be applied to a variety of different diameter of nuts. In addition, the tool assembly includes the screwdriver, the inner hexagonal wrenches, and outer hexagonal opener, thereby the tool assembly can be applied to all kinds of nuts and/or screws.

In one embodiment, the first hole 112 has an inner hexagonal shape, and the first outer hexagonal opener 22 is configured to be received in the first hole 112.

Figure 4:
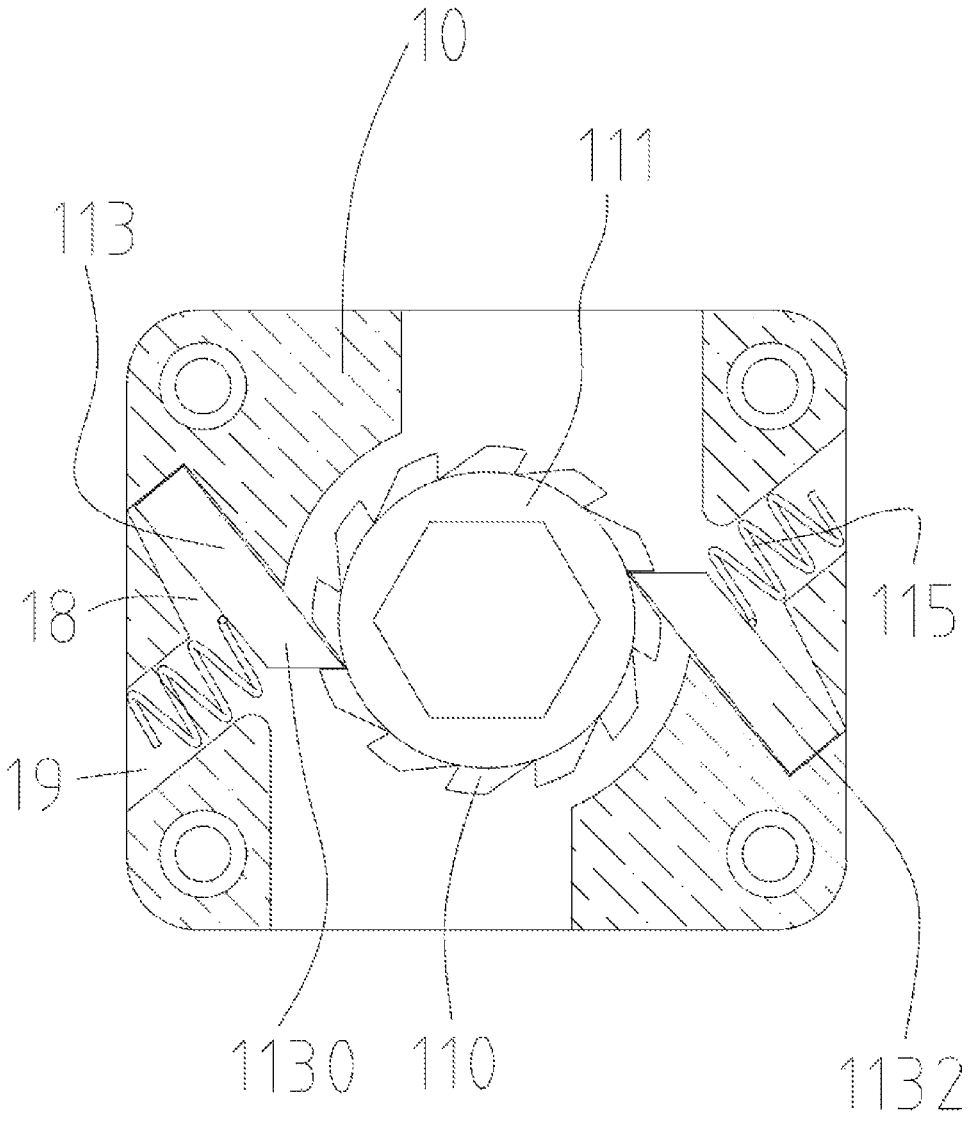
FIG. 4 is a cross-sectional view of a ratchet mechanism of the first tool of the tool assembly of FIG. 1.

Referring to FIG. 2 and FIG. 4, the ratchet mechanism 11 includes a ratchet 111 having a plurality of teeth 110, and a pair of pawls 113. A first end 1130 of each of the pawls 113 is received between two adjacent teeth 110. When the first tool 1 rotates relative to the ratchet mechanism 11 along the first direction, the pawls 113 rotates with the first tool 1 and drives the ratchet 111 and the second tool 2 rotates along the first direction; when the first tool 1 rotates along the second direction opposite to the first direction, the ratchet 111 and the second tool 2 is in a static state. That is to say, when the first tool 1 rotates along the second direction, the ratchet 111 and the second tool 2 do not rotate.

Furthermore, the inner portion of the first tool body 10 defines a pair of first receiving holes 18 and a pair of second receiving holes 19 in communication with the first receiving holes 18. A second end 1132 of each of the pawls 113 is fixed in a corresponding first receiving hole 18. The ratchet mechanism 11 includes a pair of springs 115 each received in a corresponding second receiving hole 19 and abutting against a corresponding pawl 113 to drive the corresponding pawl 113 to reset. When the first tool 1 rotates along the first direction, each of the springs 115 is in a compression state; when the first tool 1 rotates along the second direction, each of the springs 115 is in a free state.

Referring to FIGS. 1-4, when the tool assembly needs to be packaging and transportation, the second tool 2 is received in the receiving space 13, the second outer hexagonal opener 33 is inserted into the first hole 12 and the second hole 23, and the screwdriver 31 is received in the receiving groove 14, so that the first tool 1, the second tool 2, and the third tool 3 can be integrated as a whole, resulting in facilitating to packaging and transportation, and preventing the second tool 2 and the third tool 3 from accidental loss.

In use, the third tool 3 is disengaged from the first tool 1, and the second tool 2 is disengaged from the first tool 1. When the inner hexagonal wrench 21 needs to be used, the first outer hexagonal opener 22 is received in the first hole 112, the first tool 1 is rotated along the first direction and drives the second tool 2 to rotate, and when the first tool 1 is rotated along the second direction, the second tool 2 is in the static state. That is to say, when the inner hexagonal wrench 21 need to be used, the ratchet mechanism 11 can drive the second tool 2 to rotate, and the second tool 2 needs not be taken off to adjust angle, thereby improving efficiency and saving time and effort. When the screwdriver 31 needs to be used, the second outer hexagonal opener 33 is inserted into the first hole 12 and the second hole 2, thereby improving efficiency and saving time and effort.

In another embodiment, the tool assembly can be used in bicycles, cars, or motorcycles.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A tool assembly, comprising:

a first tool comprising a first tool body, a ratchet mechanism defining a first hole and located in an inner portion of the first tool body, a receiving space extending through the first tool body along an axial direction of the first tool body, a first connecting hole located in an end of the first tool body, and a receiving groove located a face of the first tool body;

a second tool comprising a first inner hexagonal wrench located a first end thereof and a first outer hexagonal opener located a second end thereof, wherein the second tool is configured to be received in the receiving space; and an L-shaped third tool comprising a screwdriver and a second outer hexagonal opener, wherein the second outer hexagonal opener is configured to be inserted into the first connecting hole, and the screwdriver is configured to be received in the receiving groove;

wherein when the first tool rotates relative to the ratchet mechanism along a first direction, the ratchet mechanism rotates along the first direction; when the first tool rotates alone a second direction opposite to the first direction, the ratchet mechanism is in a static state.

2. The tool assembly of claim 1, wherein the first inner hexagonal wrench defines a second hole corresponding to the first hole, the second outer hexagonal opener is configured to be inserted into the first hole and the second hole.

3. The tool assembly of claim 1, wherein the first tool comprises a pair of second inner hexagonal wrenches located in inner faces of opposite ends of the receiving space.

4. The tool assembly of claim 1, wherein the second outer hexagonal opener comprises a protruding portion to prevent the second outer hexagonal opener from accidentally disengaging from the first tool.

5. The tool assembly of claim 1, wherein the first hole has an inner hexagonal shape, and the first outer hexagonal opener is configured to be received in the first hole.

6. The tool assembly of claim 5, wherein the ratchet mechanism comprises a ratchet having a plurality of teeth and a pair of pawls, and a first end of each of the pawls is received between two adjacent teeth, wherein when the first tool rotates relative to the ratchet mechanism along the first direction, the pawls rotates with the first tool and drives the ratchet and the second tool rotates along the first direction; when the first tool rotates along the second direction opposite to the first direction, the ratchet and the second tool is in a static state.

7. The tool assembly of claim 6, wherein the first tool defines a pair of first receiving holes and a pair of second receiving holes in communication with the first receiving holes.

8. The tool assembly of claim 7, wherein a second end of each of the pawls is fixed in a corresponding first receiving hole.

9. The tool assembly of claim 7, wherein the ratchet mechanism comprises a pair of springs each received in a corresponding second receiving hole and abutting against a corresponding pawl to drive the corresponding pawl to reset.

10. The tool assembly of claim 9, wherein when the first tool rotates along the first direction, each of the springs is in a compression state; when the first tool rotates along the second direction, each of the springs is in a free state.

11. A tool assembly, comprising:

a first tool comprising a first tool body, a ratchet mechanism defining a first hole and located in an inner portion of the first tool body, and a receiving space extending through the first tool body along an axial direction, the ratchet mechanism comprising a ratchet having a plurality of teeth and a pair of pawls, and a first end of each of the pawls is received between two adjacent teeth; and a second tool comprising a first inner hexagonal wrench located a first end thereof and a first outer hexagonal opener located a second end thereof, wherein the first outer hexagonal opener is configured to be received in the first hole; and an L-shaped third tool comprising a screwdriver and a second outer hexagonal opener, and the first tool defines a first connecting hole located in an end of the first tool body and a receiving groove located a face of the first tool body, wherein the second outer hexagonal opener is configured to be inserted into the first connecting hole, and the screwdriver is configured to be received in the receiving groove;

wherein when the first tool rotates relative to the ratchet mechanism along a first direction, the pawls rotates with the first tool and drives the ratchet together with the second tool rotates along the first direction; when the first tool rotates along a second direction opposite to the first direction, the ratchet together with the second tool is in a static state.

12. The tool assembly of claim 11, wherein the inner portion of the first tool body defines a pair of first receiving holes and a pair of second receiving holes in communication with the first receiving holes.

13. The tool assembly of claim 12, wherein a second end of each of the pawls is fixed in a corresponding first receiving hole.

14. The tool assembly of claim 12, wherein the ratchet mechanism comprises a pair of springs each received in a corresponding second receiving hole and abutting against a corresponding pawl to drive the corresponding pawl to reset.

15. The tool assembly of claim 14, wherein when the first tool rotates alone the first direction, each of the springs is in a compression state; when the first tool rotates along the second direction, each of the springs is in a free state.

16. The tool assembly of claim 11, wherein the first inner hexagonal wrench defines a second hole corresponding to the first connecting hole, the second outer hexagonal opener is configured to be inserted into the first connecting hole and the second hole.

17. The tool assembly of claim 11, wherein the second outer hexagonal opener comprises a protruding portion to prevent the second outer hexagonal opener from accidentally disengaging from the first tool.

18. The tool assembly of claim 11, wherein the first tool comprises a magnet located in a bottom face of the receiving groove.

19. The tool assembly of claim 11, wherein the first tool comprises a pair of second inner hexagonal wrenches located in inner faces of opposite ends of the receiving space.

* * * * *